US008118514B2

(12) United States Patent
Dukes

(10) Patent No.: US 8,118,514 B2
(45) Date of Patent: Feb. 21, 2012

(54) COMBINATION FLIPBOOK AND PULL-UP FOCAL HEADER

(75) Inventor: Gary Dukes, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 908 days.

(21) Appl. No.: 12/116,057

(22) Filed: May 6, 2008

(65) Prior Publication Data

US 2009/0277058 A1 Nov. 12, 2009

(51) Int. Cl.

| | |
|---|---|
| ***B42F 3/00*** | (2006.01) |
| ***B42F 13/12*** | (2006.01) |
| ***B42F 13/40*** | (2006.01) |
| ***B42F 3/02*** | (2006.01) |
| ***B42F 13/02*** | (2006.01) |
| ***B42F 13/20*** | (2006.01) |
| ***B42F 13/00*** | (2006.01) |

(52) U.S. Cl. ..... 402/70; 402/5; 402/19; 402/20; 402/31; 402/73; 402/76; 402/502; 402/503

(58) Field of Classification Search ..... 402/5, 19, 402/20, 31, 70, 73, 76, 80 R, 502, 503
See application file for complete search history.

(56) References Cited

U.S. PATENT DOCUMENTS

| | | | | |
|---|---|---|---|---|
| 2,879,899 | A | 3/1959 | Shenkin | |
| 3,043,047 | A | 7/1962 | Fleur | |
| 4,120,400 | A * | 10/1978 | Kotyuk | 206/1.5 |
| 4,572,380 | A | 2/1986 | Langwell | |
| 4,821,437 | A | 4/1989 | Abramson et al. | |
| 4,854,535 | A | 8/1989 | Winter et al. | |
| 4,976,357 | A | 12/1990 | Pearson | |
| 5,375,802 | A | 12/1994 | Branham, II | |
| 6,119,383 | A * | 9/2000 | Gruneisen, III | 402/70 |
| 6,532,691 | B2 * | 3/2003 | Carlin et al. | 40/491 |
| 6,666,609 | B2 | 12/2003 | Fanning | |
| 2004/0118027 | A1 | 6/2004 | Tobey | |

* cited by examiner

*Primary Examiner* — Dana Ross
*Assistant Examiner* — Justin Lewis
(74) *Attorney, Agent, or Firm* — Griffiths & Seaton PLLC

(57) ABSTRACT

A display system includes a binder, a header, a retaining bracket and an extension assembly. The binder includes a plate, a plurality of sheets and an attachment assembly. The plate has a front surface, a rear surface and an edge. The attachment assembly secure the sheets at the front surface of the plate and maintains and displays information. The header includes indicia and is adapted to be positioned in a retracted position where the header is substantially obscured from view by the plate and an extended position where the header extends substantially from the edge of the plate. The retaining bracket is attached to the rear surface of the plate. The extension assembly is adapted to engage the retaining bracket to maintain the header in the extended position.

11 Claims, 11 Drawing Sheets

COMBINATION FLIPBOOK AND PULL-UP FOCAL HEADER

BACKGROUND

Various types of displays are used to provide information to consumers in a retail environment. Displays that are eye-catching and that readily provide comprehensive information about the product offered for sale help draw the attention of the consumers and promote retail sales. Additionally, displays having information that is easily changeable and adjustable provides more efficient use of resources, including better use of employee time and reduced costs, for example. While traditional displays accomplish these features to some extent, enhancements in the functionality, or overall merchandising effectiveness, of such displays remain to be realized.

SUMMARY

Some aspects relate to a display system including a binder, a header, a retaining bracket and an extension assembly. The binder includes a plate, a plurality of sheets and an attachment assembly. The plate has a front surface, a rear surface and an edge. The attachment assembly secures a plurality of sheets at the front surface of the plate and maintains and displays information. The header includes indicia and is adapted to be positioned in a retracted position where the header is substantially obscured from view by the plate and an extended position where the header extends substantially from the edge of the plate. The retaining bracket is attached to the rear surface of the plate. The extension assembly is adapted to engage the retaining bracket to maintain the header in the extended position.

Other aspects relate to a merchandising system including a flipbook and a display assembly. The flipbook includes a panel and first and second jaws connected to the panel. The first and second jaws are adapted to be transitioned between an open position and a closed position, where the jaws are adapted to secure a plurality of pages such that the pages are able to be turned when the jaws are in the closed position. The display assembly includes a support connected to the panel, a substantially U-shaped spring clip assembly positioned between the panel and the support and a display connected to the substantially U-shaped spring clip assembly. The spring clip assembly includes a clip adapted to slidably engage the support at a plurality of detent positions. The detent positions include a first position where the display is substantially hidden behind the panel and a second position where the display is revealed from behind the panel Still other aspects relate to a method of displaying information including releasably attaching a display platform to a base assembly; urging a first spring and a second spring connected to a first end and a second end of a substantially linear bar, respectively, in opposite directions; moving an extension attached to the substantially linear bar from an edge of the board such that the extension is viewable above the edge of the board; and releasing the springs such that teeth protruding from an edge of the first and second springs abut an edge of the substantially linear bar.

This Summary is not intended to be limiting, as various other aspects are contemplated and should be understood with reference to the text and drawings that follow.

Figure 1:
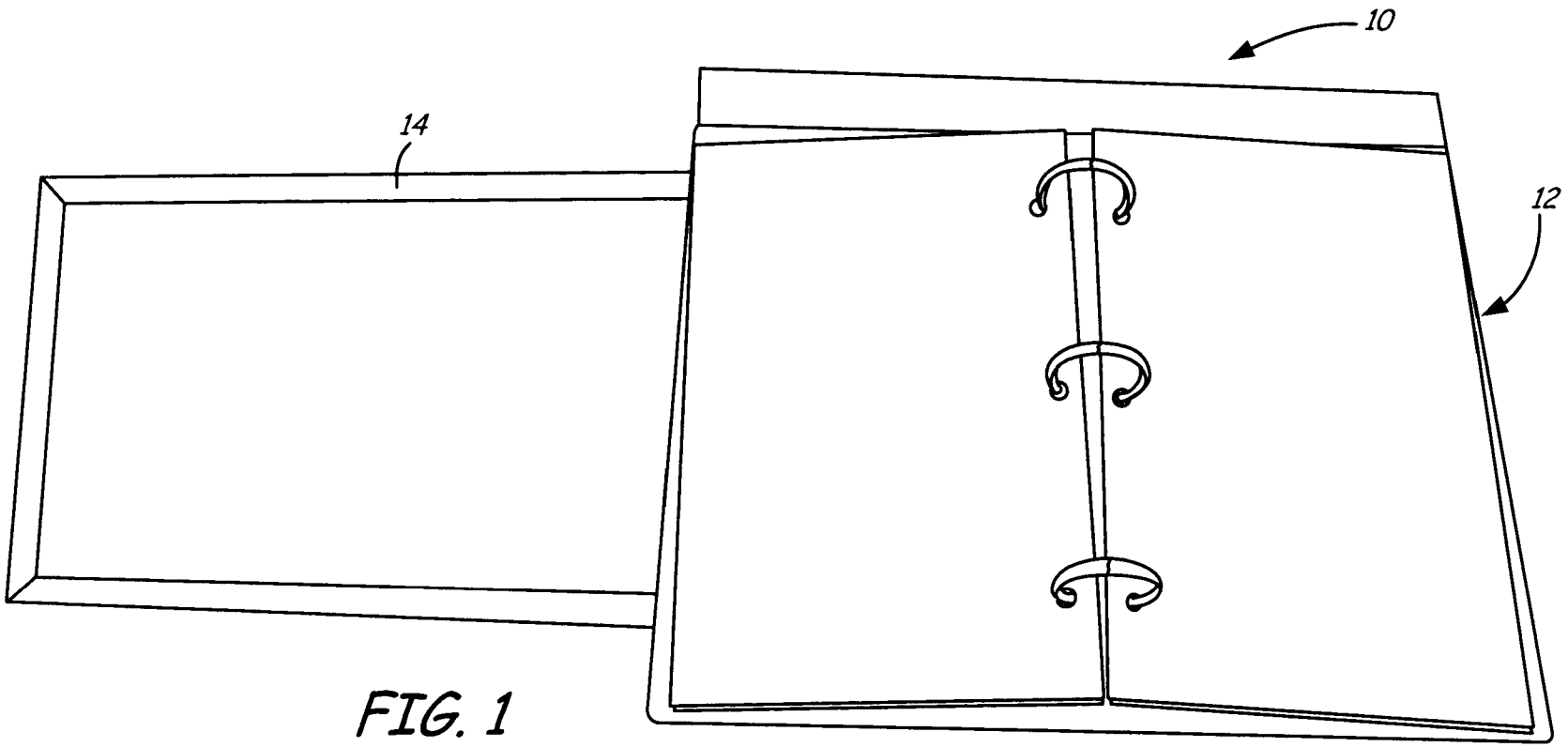
FIG. 1 is perspective view of a display system, according to some embodiments.

While the invention is amenable to various modifications and alternative forms, some embodiments have been shown by way of example in the drawings and are described in detail below. As alluded to above, the intention, however, is not to limit the invention by those examples. On the contrary, the invention is intended to cover all modifications, equivalents, and alternatives.

DETAILED DESCRIPTION

In general terms, some aspects of the invention relate to a display system for providing product information or other retail information as desired to a consumer in a retail environment, for example. The display system optionally includes a flipbook and an adjustable focal header that is extended above the flipbook as desired to provide a quick reference for information in the flipbook and is able to be retracted to be hidden from view as desired.

FIG. 1 shows a perspective view of a display system 10 for providing information to a user, according to some embodiments. The display system 10, also described as a display platform or a merchandising system, includes an information stand 12 mounted to a panel 14, which is mounted to a wall or base assembly (e.g., by mount 300 shown in FIGS. 9, 10A, 10B and 10C). The display system 10 provides a means for displaying information about a product positioned in proximity to the display system 10. For example, the display system 10 is positioned in a retail environment to provide users with technical information on the product. In some embodiments, the product includes many features and the display system 10 provides product comparisons so that users are better able to make informed purchases.

Figure 2:
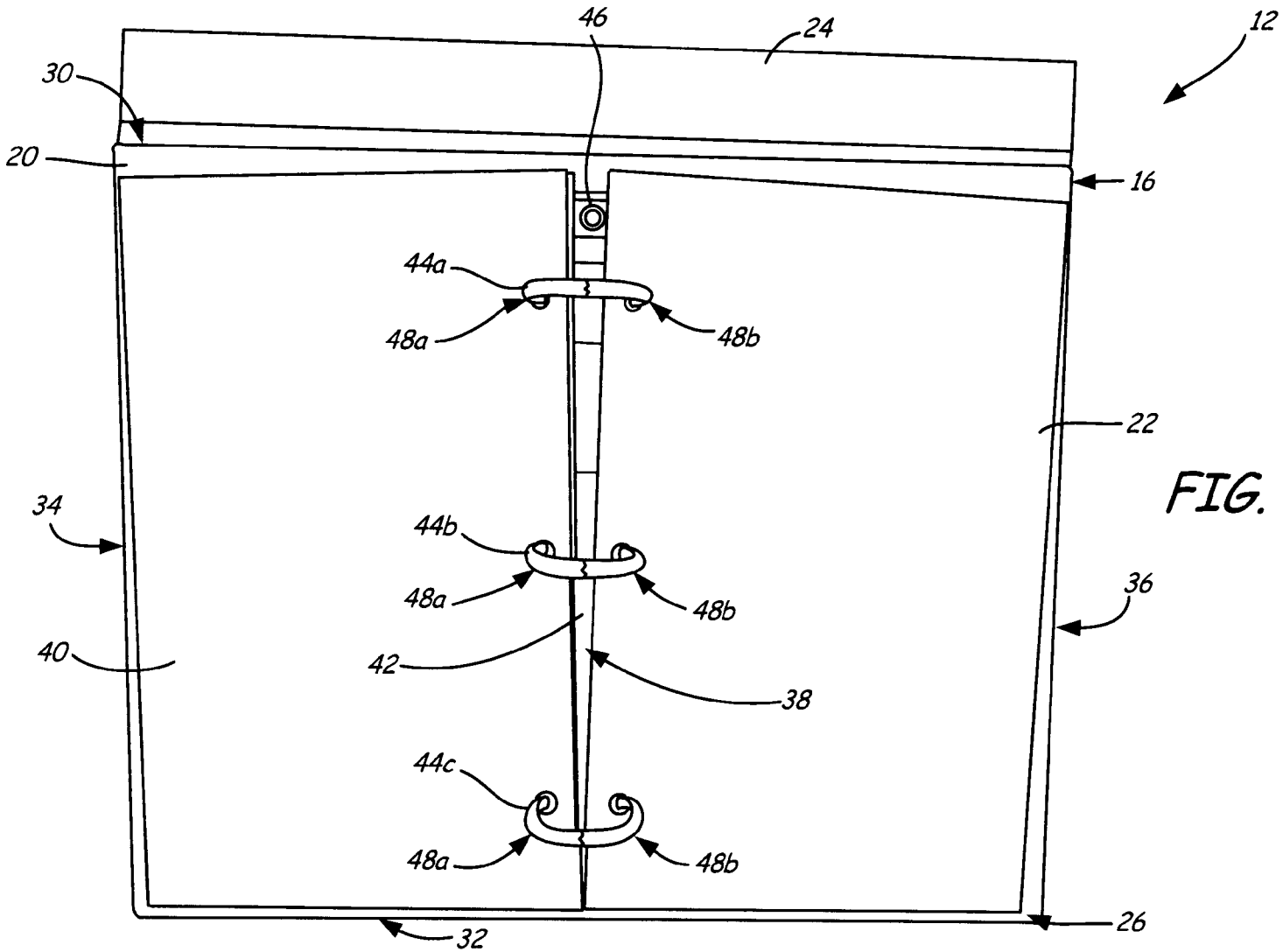
FIG. 2 is a front view of an information stand of the display system of FIG. 1, according to some embodiments.
Figure 3:
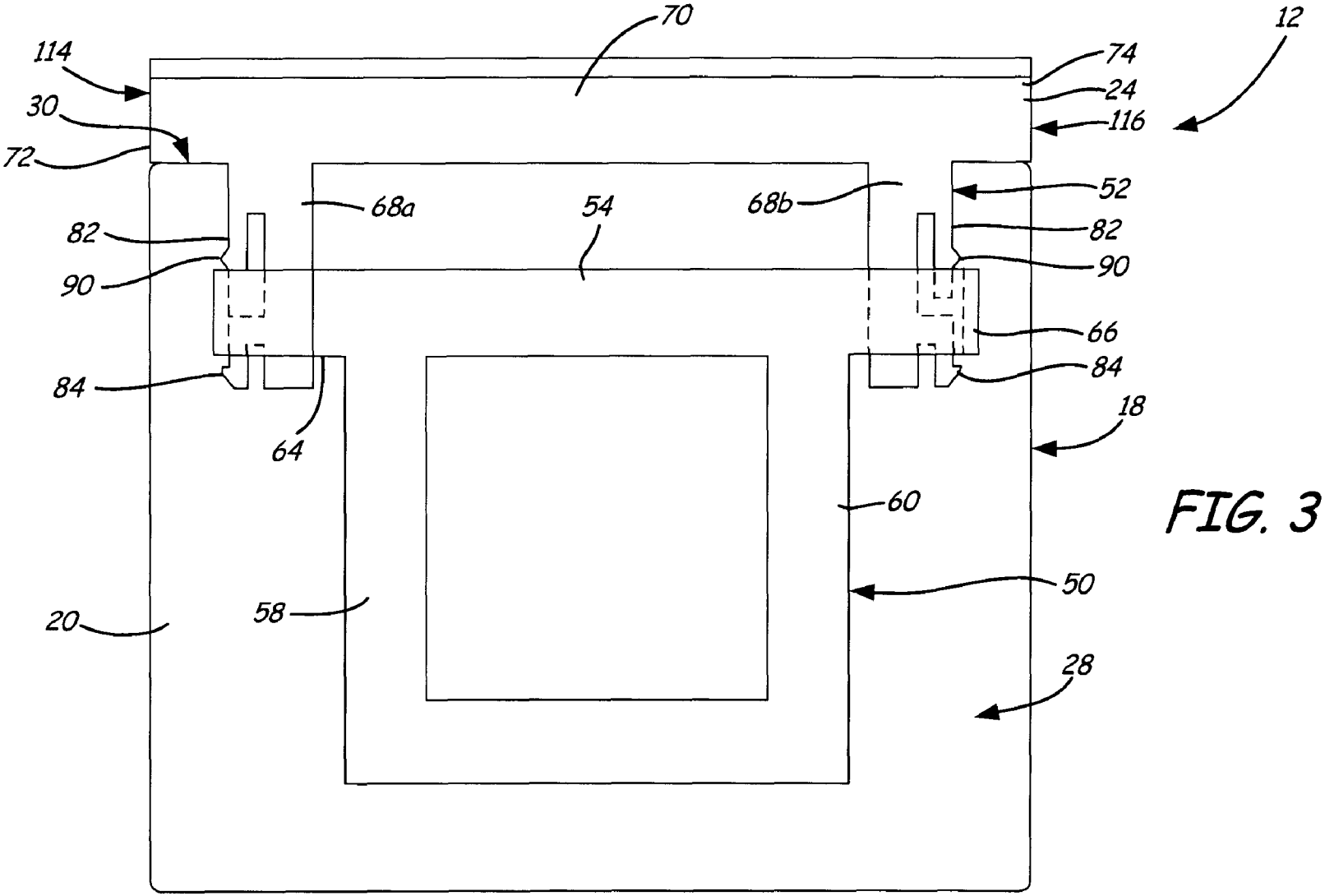
FIG. 3 is a rear view of the information stand of FIG. 2 with a focal header in an extended position, according to some embodiments.

FIG. 2 shows a front view of the information stand 12. The information stand 12, also described as a display platform, includes a front side 16 and a rear side 18 (FIG. 3). The information stand 12 includes a plate 20, a flipbook 22 and a focal header 24. The plate 20, also described as a panel or board, is optionally substantially flat and includes a front side 26, a rear side 28 (FIG. 3), a top edge 30, a bottom edge 32, a first side edge 34 and a second side edge 36. Although the plate 20 is depicted in FIG. 2 as being substantially rectangular, the plate 20 optionally takes any of a variety of shapes without departing from the intended scope of the present invention. The plate 20, also described as a support plate or a board, is about 10.5 inches long and about 8.5 inches high, although other dimensions are contemplated. In other embodiments, to accommodate larger signs and displays, for example, the plate 20 is about 19.3 inches long and about 9.875 inches high, although other dimensions are contemplated.

In some embodiments, the flipbook 22, also described as a binder, is positionable within the perimeter of the plate 20 and includes a binder portion 38 for securing sheets 40, of, for example, paper, containing informational content to the flipbook 22. Although paper is shown and described, it should be readily understood any of a variety of mediums and materials for communicating information are contemplated. The binder portion 38, also described as an attachment assembly, has a mounting flange 42 and first, second and third retention means 44*a*, 44*b*, 44*c* (collectively referred to as "retention means 44") connected to the mounting flange 42. In some embodiments, the mounting flange 42 is positioned in the center of the plate 20 such that the sheets 40 do not extend beyond the edges 30, 32, 34, 36 of the plate 20 and is connected to the plate 20 using any of a variety of fastening means, including screws 46, for example.

The retention means 44 includes a first set of jaws 48*a* and a second set of jaws 48*b* that are moveable between an open position and a closed position. When the retention means 44 are in the open position, the first and second set of jaws 48*a* and 48*b* are spaced from each other such that the sheets 40 are able to be inserted between, or attached to, the retention means 44. When the retention means 44 are in the closed position, the first and second sets of jaws 48*a* and 48*b* engage each other such that the sheets 40 are secured to the retention means 44 and is retained there until the retention means 44 is moved back to the open position. The binder portion 38 is about 7.5 inches high and about 0.81 inches wide, although other dimensions are contemplated.

The focal header 24, also described as a header, display or extension, displays product information or company logos, for example, related to the information provided in the flipbook 22. The focal header 24 is mounted to the plate 20 and is positionable, or able to be transitioned, between an extended position and a retracted position relative to the top edge 30 of the plate 20.

FIG. 3 shows a rear view of the information stand 12 with the focal header 24 in the extended position, according to some embodiments. As shown, the information stand 12 also includes a retaining bracket 50 and a spring assembly 52. The retaining bracket 50 is mounted to the rear side 28 of the plate 20 and serves at least two functions. The retaining bracket 50 houses the spring clip assembly 52 and operatively attaches the information stand 12 to the panel 14 (FIG. 1). The spring clip assembly 52 moves the focal header 24 between the extended and retracted positions with respect to the top edge 30 of the plate 20.

Figure 4:
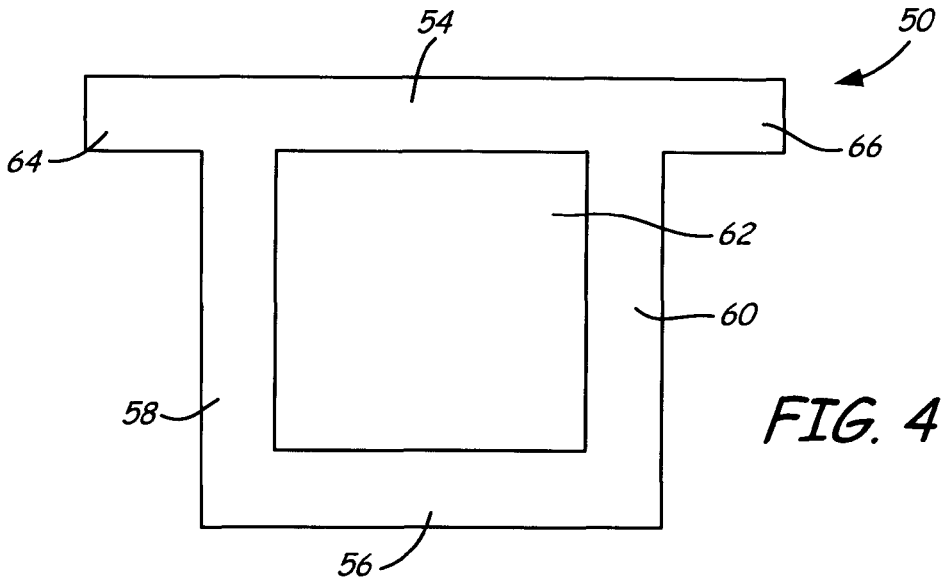
FIG. 4 shows a front view of a retaining bracket of the display system of FIG. 1, according to some embodiments.

FIG. 4 shows a front view of the retaining bracket 50, according to some embodiments. The retaining bracket 50, also described as a support or a mounting panel, includes a top bar 54, a bottom bar 56, a first side bar 58 and a second side bar 60. The top bar 54 and the bottom bar 56 are each attached to and extend between the first side bar 58 and the second side bar 60 at substantially 90° angles to form a substantially rectangular shape. The bars 54, 56, 58, 60 are sized such that an opening 62 is formed by the bars 54, 56, 58, 60. The top bar 54 is longer than the bottom, first side, and second side bars 56, 58, 60 and includes a first end 64 and a second end 66 that extend past the first and second side bars 58, 60, respectively. The bars 54, 56, 58, 60 of the retaining bracket 50 are formed integrally or are connected by any of a variety of means, such as by welding, for example. The retaining bracket 50 is formed of metal or other suitable material.

The top bar 54 is about 9.125 inches long and about 1 inch high. The bottom bar 56 is about 6 inches long and about 1 inch high. The first and second side bars 58, 60 are about 4 inches long and about 1 inch wide. The first and second ends 64, 66 of the top bar 54 extend about 1.562 inches beyond the first and second bars 58, 60, respectively. In other embodiments, to accommodate larger signs and displays, the top bar 54 is about 14 inches long and about 1 inch high. The bottom bar 56 is about 8 inches long and about 1 inch high. The first and second side bars 58, 60 are about 4 inches long and about 1.75 inches wide. The first and second ends 64, 66 of the top bar 54 extend about 3 inches beyond the first and second side bars 58, 60, respectively. Although exemplary dimensions are given for the retaining bracket 50, other dimensions are contemplated.

Figure 5A:
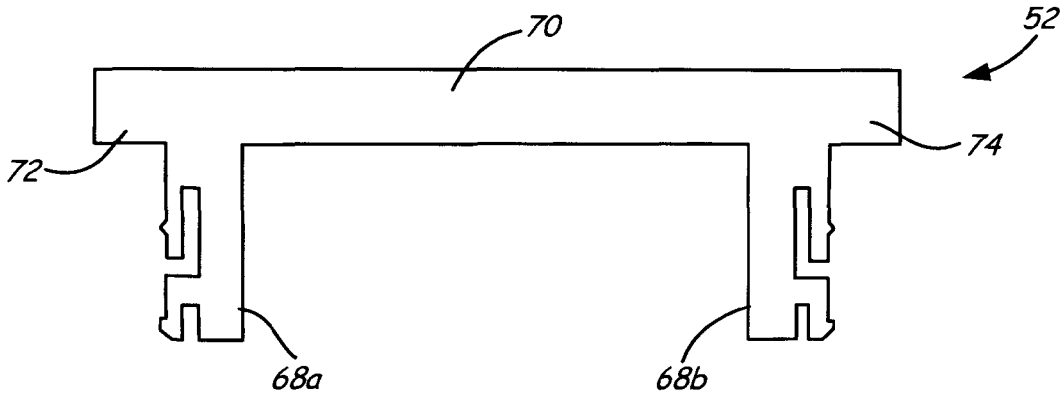
FIG. 5A shows a front view of a spring clip assembly of the display system of FIG. 1, according to some embodiments.
Figure 5B:
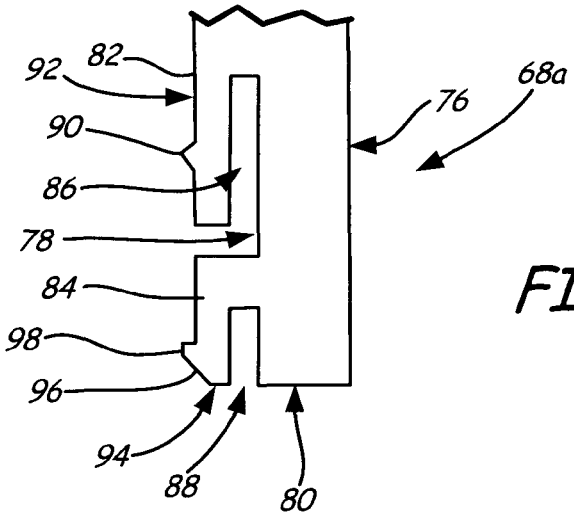
FIG. 5B is an enlarged front view of a spring clip of the spring clip assembly of FIG. 5A, according to some embodiments.

FIG. 5A shows a front view of the spring clip assembly 52, according to some embodiments. FIG. 5B shows an enlarged front view of a first spring clip 68*a*. FIGS. 5A and 5B will be discussed in conjunction with one another. The spring clip assembly 52, also described as an extension assembly, includes a first spring clip 68*a*, a second spring clip 68*b* (the first and second spring clips 68*a*, 68*b* are collectively referred to as "spring clips 68") and a substantially linear portion 70 connected to the focal header 24 (FIG. 3). The linear portion 70 has a first end 72 and a second end 74. The first spring clip 68*a* extends at about a 90° angle relative to the first end 72 and the second spring clip 68*b* extends at about a 90° angle relative to the second end 74, although other angular offsets are contemplated.

Referring in particular to FIG. 5B, the second spring clip 68*b* is optionally substantially a mirror-image of the first spring clip 68*a*, and as such can be described cumulatively with reference to the first spring clip 68*a*. The first spring clip 68*a*, also described as a spring, has a substantially smooth first edge 76, a second edge 78 opposite the first edge 76 and a bottom edge 80 connecting the first and second edges 76, 78. A top extension 82 and a bottom extension 84 are each substantially L-shaped and each protrude from the second edge 78 of the first spring clip 68*a*. The top and bottom extensions 82, 84 extend from the second edge 78 of the first spring clip 68*a* at substantially the same distance to form a first mouth 86 and a second mouth 88, respectively. The top extension 82 includes a triangular projection 90 along an outer edge 92 of the top extension 82. The bottom extension 84 extends from the second edge 78 of the first spring clip 68*a* such that an end 94 of the bottom extension 84 is aligned with the bottom edge 80 of the first spring clip 68*a*. The end 94 of the bottom extension 84 includes a taper 96 and a step 98. The top and bottom extensions 82, 84 of the spring clips 68 help to maintain the focal header 24 in either the extended position or the retracted position.

The substantially linear portion 70 of the spring clips 68 is formed integrally or are connected by any means known in the art. The spring clip assembly 52 is formed of plastic or other suitable pliable material. The substantially linear portion 70 of the spring clips 68 is about 10.5 inches long and about 1 inch high, although other dimensions are contemplated.

Each of the spring clips 68*a*, 68*b* is about 1 inch wide (including the top and bottom extensions 82, 84) and about 2.625 inches tall and are positioned about 1.25 inches away from the first and second ends 72, 74, respectively, of the substantially linear portion 70. The top extensions 82 are about 1 inch long and the bottom extensions 84 are about 0.832 inches long. The top and bottom extensions 82, 84 are about 0.218 inches wide with the triangular projections 90 and the steps 98 extending about 0.511 inches from the second edges 78 of the spring clips 68. The steps 98 of the bottom extensions 84 are positioned about 0.250 inches from the end 94. The mouths 86, 88 of the spring clips 68 are about 0.2 inches wide. In other embodiments, to accommodate larger signs and displays, for example, the substantially linear portion 70 is about 19.375 inches long and about 2 inches high and the spring clips 68 are about 3.236 inches high and about 1.70 inches wide. The triangular projections 90 extend about 0.09 inches from the second edges 78 of the spring clips 68 and the steps 98 extend about 0.12 inches from the second edges 78 of the spring clips 68. Although exemplary dimensions are given for the spring clips 68, other dimensions are contemplated.

Figure 6:
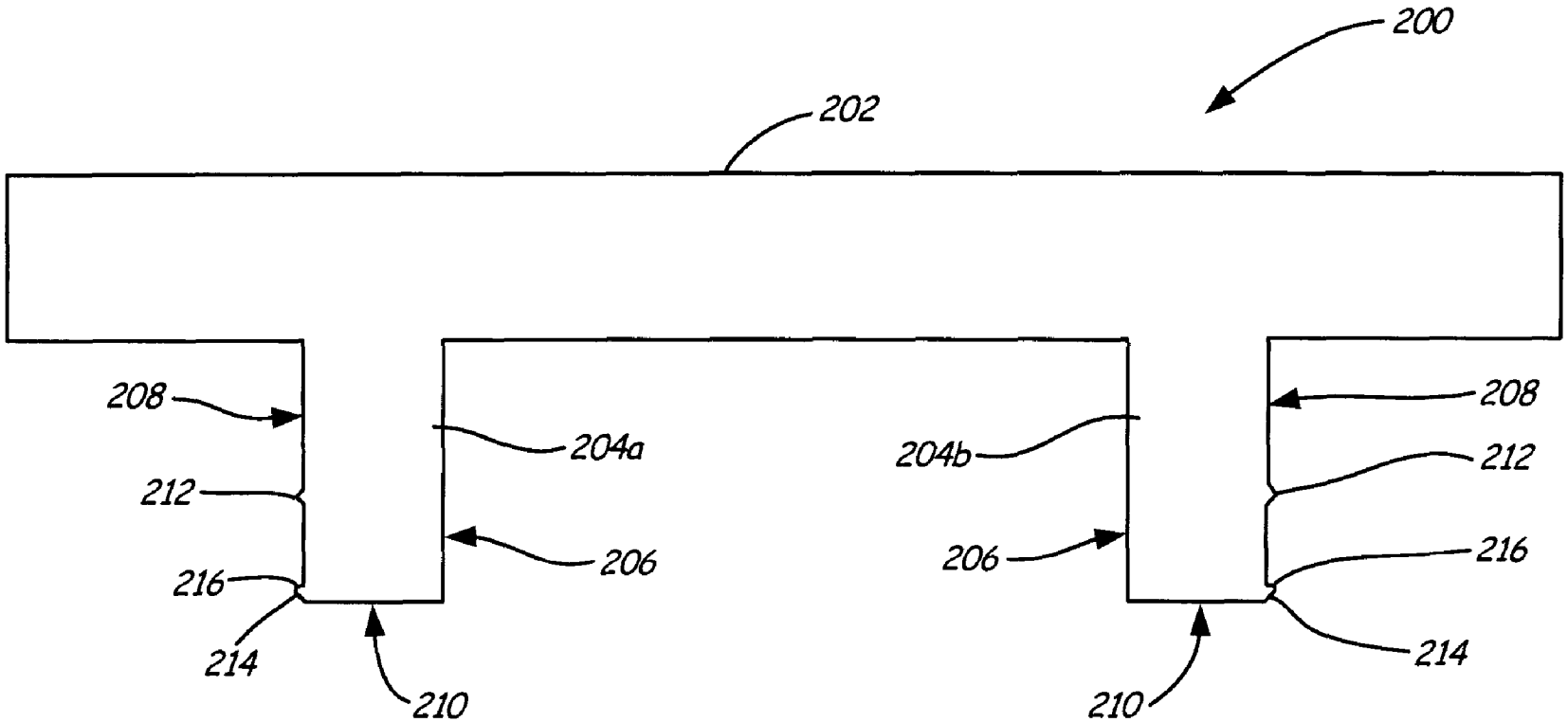
FIG. 6 shows a front view of another spring clip assembly, according to some embodiments.

FIG. 6 shows another spring clip assembly 200 according to some embodiments. The spring clip assembly 200 includes a substantially linear portion 202, a first spring clip 204*a* and a second spring clip 204*b* (the first spring clip 204*a* and the second spring clip 204*b* are collectively referred to as "spring clips 204"). The spring clip assembly 200 optionally functions substantially similar to the spring clip assembly 52 depicted in FIG. 5A. The spring clips 204 include a first edge 206, a second edge 208 and a bottom edge 210. In some embodiments, the second edges 208 do not include any extensions but do include a triangular projection 212 along the second edge 208 and a taper 214 from the bottom edge 210 to the second edge 208, resulting in a step 216. The substantially linear portion 202 is optionally attached to the focal header 24 (FIG. 3) in substantially the same manner as the substantially linear portion 70. Likewise, the spring clips 204 interact with the top bar 54 (FIG. 3) in substantially the same manner as the spring clips 68 of the spring clip assembly 52.

Figure 7B:
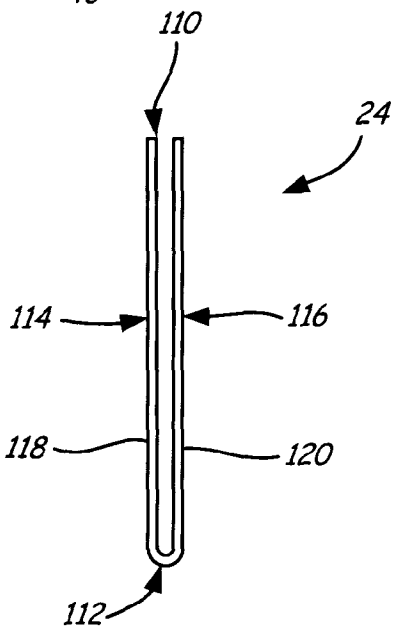
FIG. 7B is a side view of a focal header of FIG. 7A, according to some embodiments.
Figure 7A:
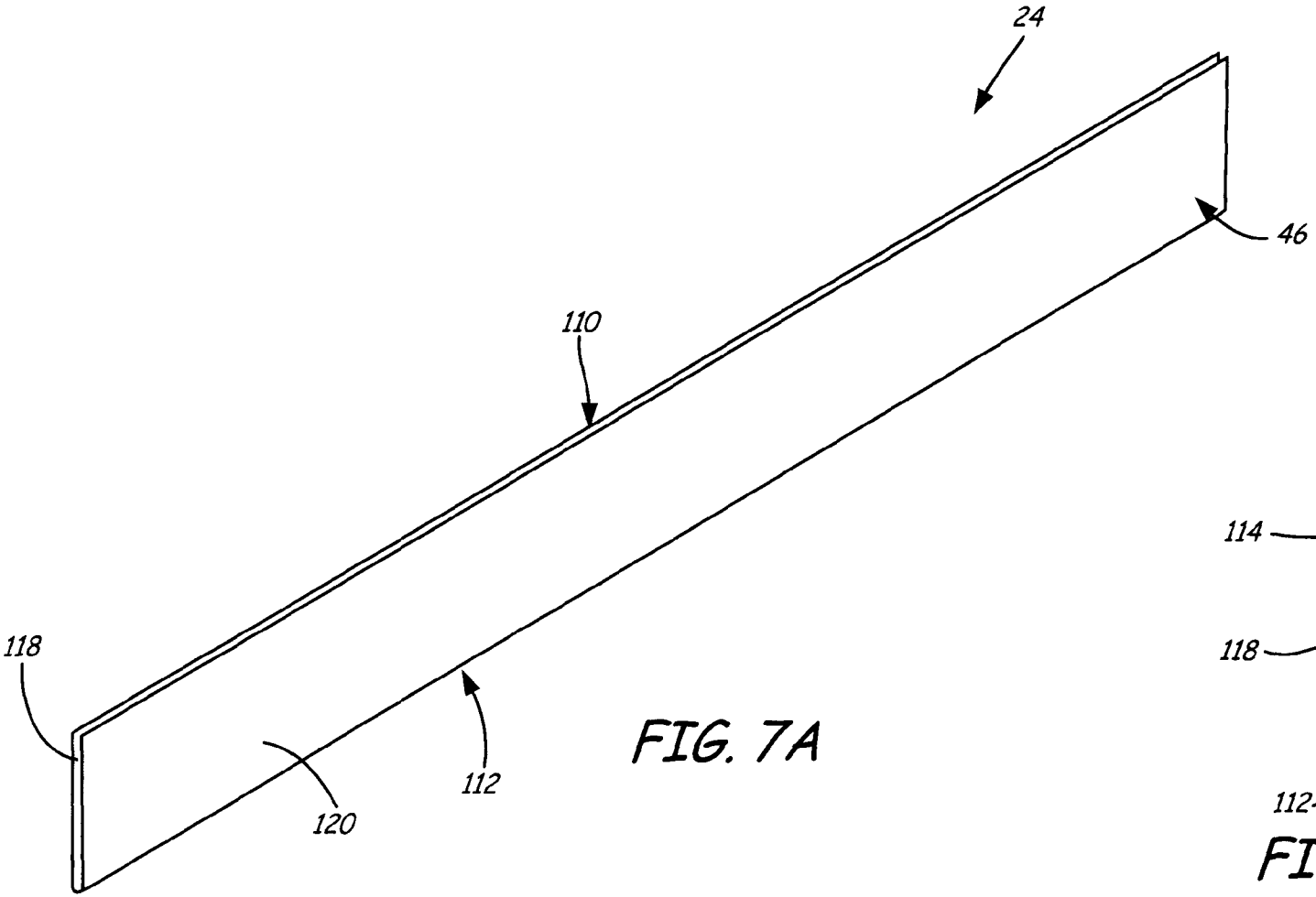
FIG. 7A is a perspective view of a focal header of the display system of FIG. 1, according to some embodiments.

FIG. 7A shows a perspective view of the focal header 24 and FIG. 7B shows a side view of the focal header 24. FIGS. 7A and 7B will be discussed collectively. The focal header 24 includes a top edge 110, a bottom edge 112, a first edge 114, a second edge 116, a first panel 118 and a second panel 120 spaced substantially parallel to the first panel 118. The first and second panels 118, 120 are connected at the bottom edge 112 such that the focal header 24 is substantially U-shaped when viewed in cross-section. The focal header 24 is about 10.5 inches long and about 1.18 inches high, although other dimensions are contemplated.

Referring back to FIG. 3, when the information stand 12 is assembled, the spring clip assembly 52 is positioned between the rear side 28 of the plate 20 and the retaining bracket 50. The focal header 24 is attached to the substantially linear portion 70 of the spring clip assembly 52 such that the focal header 24 is optionally extended and retracted based on movement of the spring clip assembly 52. The focal header 24 and the substantially linear portion 70 are aligned such that the first and second ends 72, 74 of the substantially linear portion 70 are aligned with the first and second edges 114, 116 of the focal header 24, respectively, so that the substantially linear portion 70 is not viewable by a user. In other words, the substantially linear portion 70 is substantially obscured from being viewed by a user facing the front side 16 (FIG. 2) of the information stand 12. The focal header 24 is optionally attached to the spring clip assembly 52 using any of a variety of means, including, but not limited to, an adhesive.

The substantially linear portion 70 is also substantially parallel and aligned with the top bar 54 of the retaining bracket 50 such that the first spring clip 68*a* is positioned between the first end 64 of the top bar 54 and the first side bar 58 and the second spring clip 68*b* is positioned between the second end 66 of the top bar 54 and the second side bar 60. When the focal header 24 is in the extended position, the top and bottom extensions 82, 84 of the spring clips 68 engage the first and second ends 64, 66 of the top bar 54, respectively. In addition, the projections 90 of the top extensions 82 rest on the first and second ends 64, 66 to help hold the focal header 24 in position above the top edge 30 of the plate 20. The spring clips 68 exert a force against the first and second ends 64, 66 to create a friction hold of the spring clips 68 within the top bar 54. Thus, the spring clips 68 work in conjunction with the top bar 54 to help maintain the focal header 24 in the extended position.

When the focal header 24 is in the extended position, the focal header 24 is positioned above the top edge 30 of the plate 20 such that the bottom edge 112 of the focal header 24 extends beyond the top edge 30 of the plate 20. In this position, the focal header 24 is viewable by a user facing the front side 16 of the information stand 12.

Figure 8:
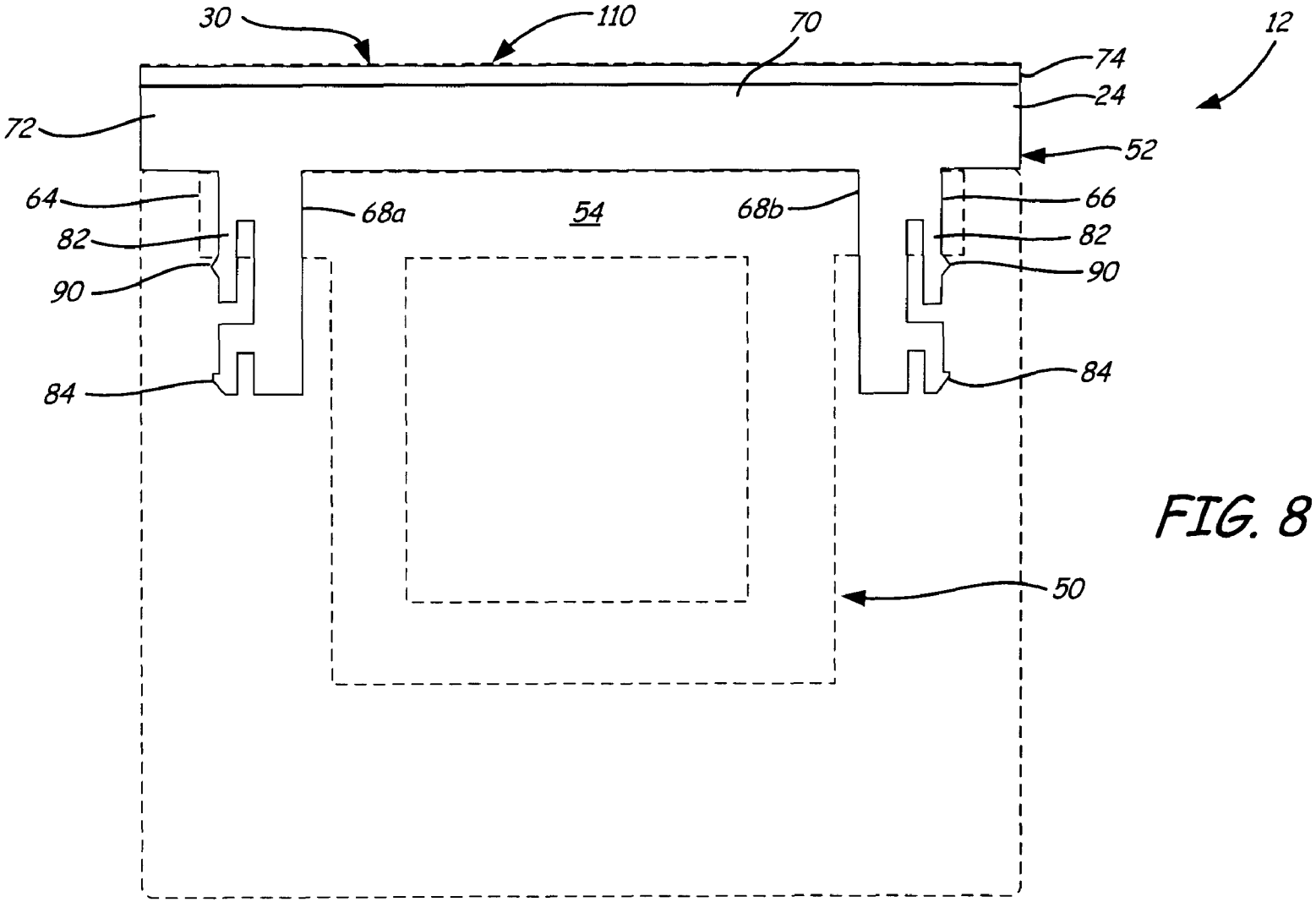
FIG. 8 is a rear view of the information stand of FIG. 2 with the focal header in a retracted position, according to some embodiments.

FIG. 8 shows a rear view of the information stand 12 with the focal header 24 in the retracted position. To move the focal header 24 from the extended position to the retracted position, the top extensions 82 are pushed toward the second edge 78 of the spring clips 68 to release the top extensions 82 and the projections 90 from the first and second ends 64, 66 of the retaining bracket 50. Once the top extensions 82 are disengaged from the top bar 54, the spring clips 68 are moved downwardly. In some embodiments, the spring clips 68 are moved downwardly until the top edge 110 of the focal header 24 is either aligned with, or below, the top edge 30 of the plate 20. In this position, the substantially linear portion 70 of the spring clip assembly 52 is aligned with the top bar 54 of the retaining bracket 50 and is not visible by an observer positioned in front of the information stand 12. The first and second ends 72, 74 of the substantially linear portion 70 rest on the first and second ends 64, 66 of the top bar 54. The projections 90 of the top extensions 82 of the spring clips 68 are also disengaged from the first and second ends 64, 66 of the top bar 54, respectively, and are positioned below the top bar 54.

Figure 9:
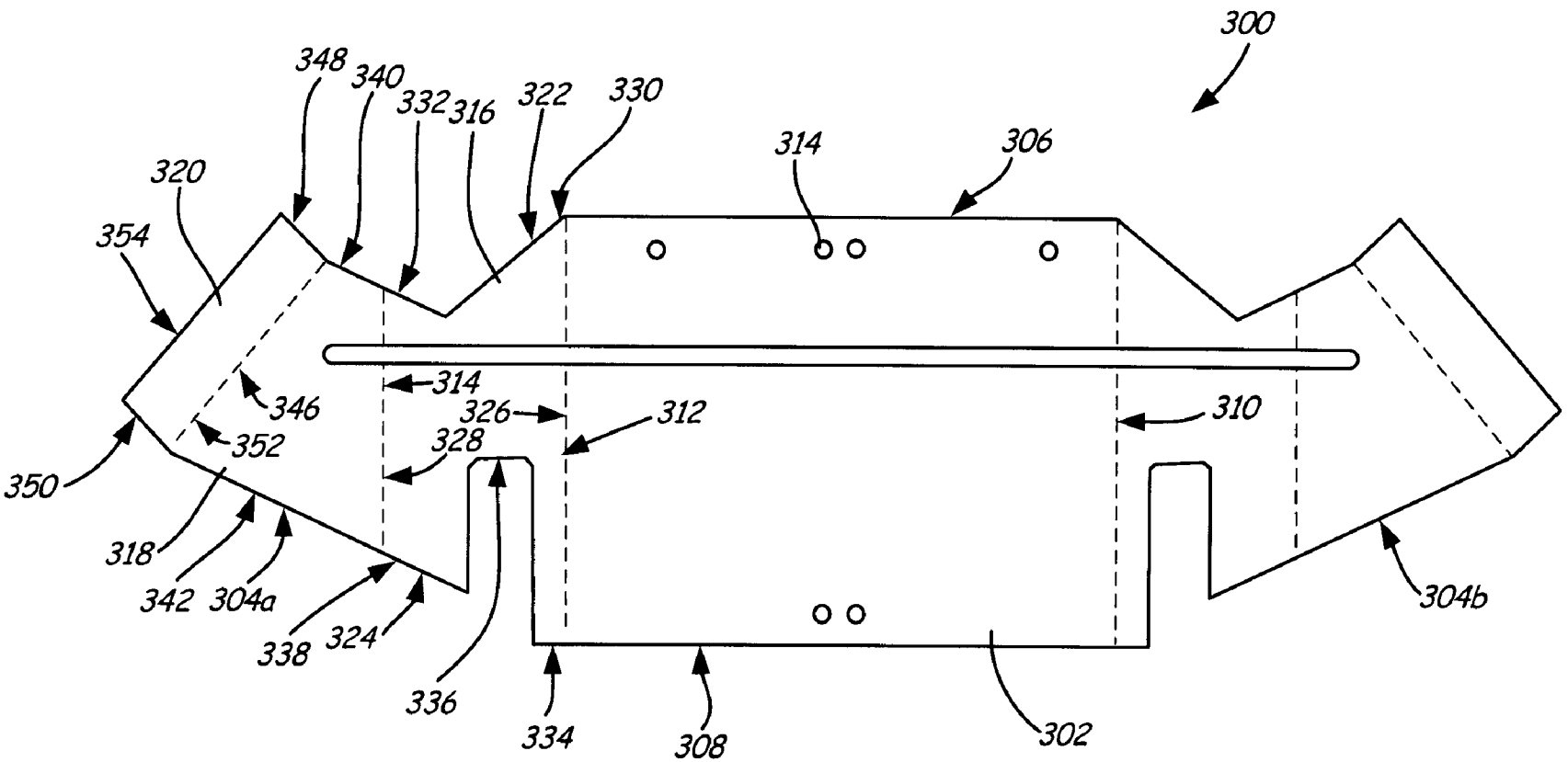
FIG. 9 is a front view of a mount of the display system of FIG. 1 prior to formation thereof, according to some embodiments.

FIG. 9 shows a front view of a mount 300 in a preformed state. The mount 300 is optionally used to support the information stand 12 and includes a body 302, a first wing portion 304*a* and a second wing portion 304*b* (the first wing portion 304*a* and the second wing portion 304*b* are collectively referred to as "wing portions 304"). The body 302 is substantially rectangular in shape and has a top edge 306, a bottom edge 308, a first side edge 310 and a second side edge 312. The body 302 optionally includes a plurality of apertures 314. The second wing portion 304*b* is optionally substantially similar to the first wing portion 304*a* and as such can be described cumulatively with reference to the first wing portion 304*a*. The first wing portion 304*a* includes an attachment section 316, an intermediate section 318 and an end section 320. The attachment section 316 is connected to the body 302, the intermediate section 318 is connected to the attachment section 316 and the end section 320 is connected to the intermediate section 318. Each of the sections 316, 318, 320 of the first wing portion 304*a* are folded with respect to each adjacent section. The attachment section 316 has a top edge 322, a bottom edge 324, a first side edge 326 and a second side edge 328. The second side edge 328 is shorter than the first side edge 326 and is spaced from the first side edge 326 by the top and bottom edges 322, 324.

The top edge 322 has a first section 330 and a second section 332. The first section 330 extends from the first side edge 326 and is angled downward to form an acute angle with the first side edge 326. The second section 332 extends from the second side edge 328 and is angled downward to form an acute angle with the second side edge 328. Because the first side edge 326 is shorter than the second side edge 328, the first and second sections 330, 332 form an obtuse angle relative to one another where the first and second sections 330, 332 meet.

The bottom edge 324 is also angled from the first side edge 326 to the second side edge 328 and includes a first section 334, a second section 336 and a third section 338. The first section 334 extends substantially linearly from the second side edge 312 of the body 302. The third section 338 is angled from the second side edge 328 and forms an obtuse angle with the second side edge 328 such that if extended to the first side edge 326 of the attachment section 316, it would intersect the second side edge 312 of the body 302. The second section 336 is recessed from the first and third sections 334, 338 and forms a substantially rectangular cut-out within the attachment section 316.

The first side edge 326 of the attachment section 316 is connected to the second side edge 312 of the body 302 and is substantially the same height as the second side edge 312 of the body 302. The second side edge 328 of the attachment section 316 is connected to the intermediate section 318 of the first wing portion 304*a*.

The intermediate section 318 has a top edge 340, a bottom edge 342, a first side edge 344 and a second side edge 346. The top edge 340 extends substantially linearly from the top edge 322 of the attachment section 316 and the bottom edge 342 extends substantially linearly from the bottom edge 324 of the attachment section 316. The top edge 340 is shorter than the bottom edge 342 and is spaced from the bottom edge 342 by the first and second side edges 344, 346. The first and second side edges 344, 346 extend from the top edge 340 at obtuse angles. Because the top edge 340 is shorter than the bottom edge 342, the first and second side edges 344, 346 form acute angles with the bottom edge 342.

The first side edge 344 of the intermediate section 318 is connected to the second side edge 328 of the attachment section 316 and is substantially the same height as the second side edge 328 of the attachment section 316. The second side edge 346 of the intermediate section 318 is connected to the end section 320 of the first wing portion 304*a*.

The end section 320 is substantially rectangular in shape and has a top edge 348, a bottom edge 350, a first side edge 352 and a second side edge 354. The top edge 348 and the bottom edge 350 are substantially the same length and are spaced from each other by the first and second side edges 352, 354. Similarly, the first side edge 352 and the second side edge 354 are substantially the same length and are spaced from each other by the top and bottom edges 348, 350. The end section 320 is connected to the intermediate section 318 such that the top edge 348 of the end section 320 forms an obtuse angle with the top edge 340 of the intermediate section 318.

The first side edge 352 of the end section 320 is connected to the second side edge 346 of the intermediate section 318 and is substantially the same height as the second side edge 346 of the intermediate section 318.

Figure 10A:
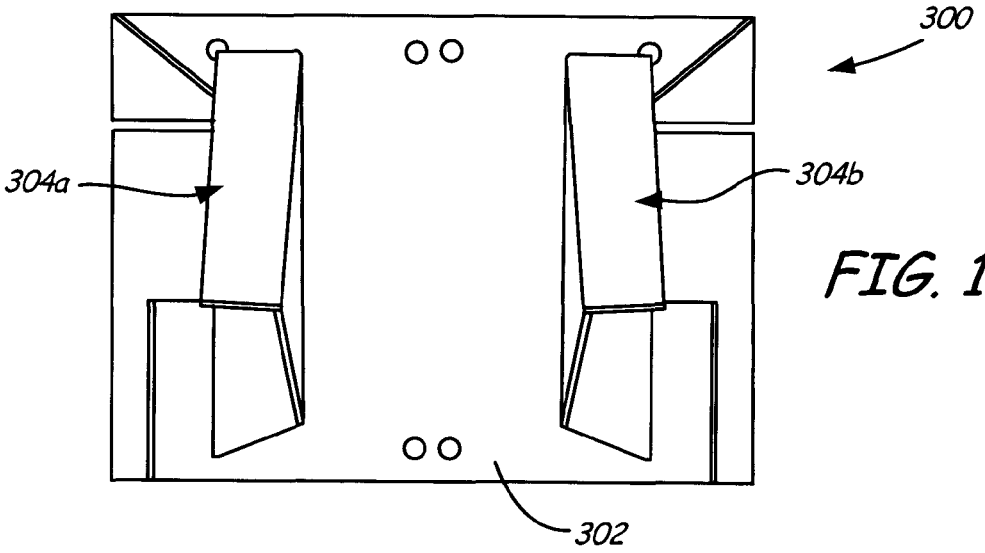
FIG. 10A is a perspective view of the mount of FIG. 9 in a formed state, according to some embodiments.
Figure 10B:
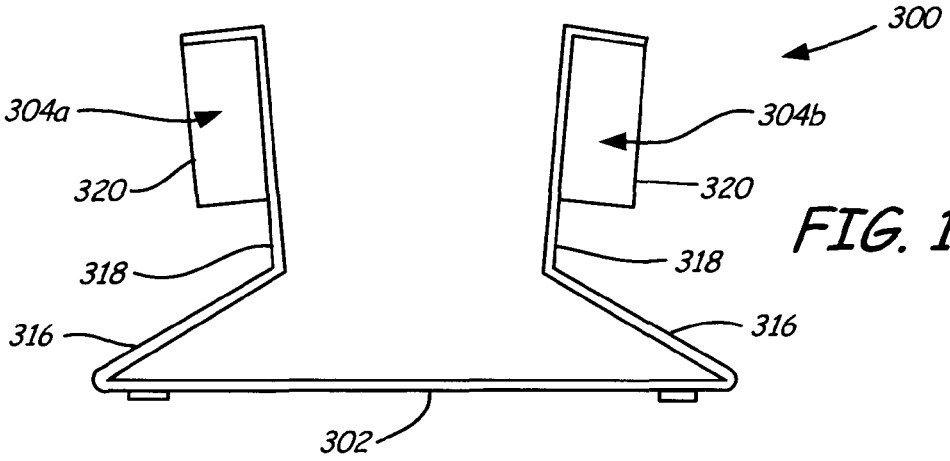
FIG. 10B shows a top view of the mount of FIG. 9 in a formed state, according to some embodiments.
Figure 10C:
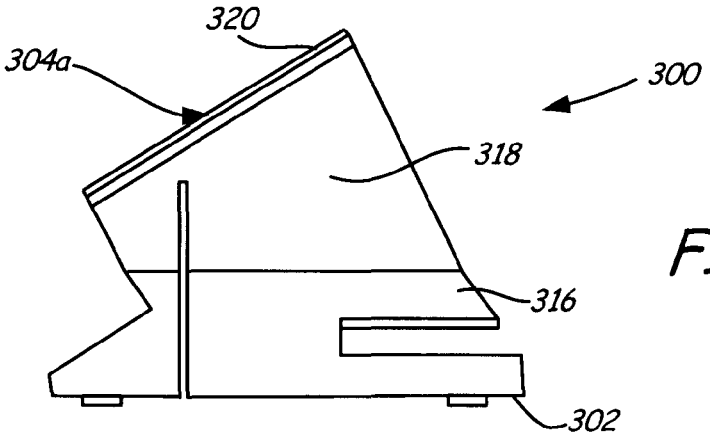
FIG. 10C shows a side view of the mount of FIG. 9 in a formed state, according to some embodiments

FIG. 10A shows a perspective view of the mount 300 in a formed state, FIG. 10B shows a top view of the mount 300 in a formed state and FIG. 10C shows a side view of the mount 300 in a formed state. The mount 300 is transitioned to the formed state in order to attach the mount 300 to the information stand 12 (FIG. 1). In some methods of transitioning the mount 300 to the formed state, the wing portions 304 of the mount 300 are folded where the attachment section 316 is connected to the body 302, the intermediate section 318 is connected to the attachment section 316 and the end section 320 is attached to the intermediate section 318. In some embodiments, the attachment section 316 is folded at about a 30° angle from the body 302, the intermediate section 318 is folded at about a 115° angle from the attachment section 316, and the end section 320 is folded at about an 88° angle from the intermediate section 316.

Figure 11:
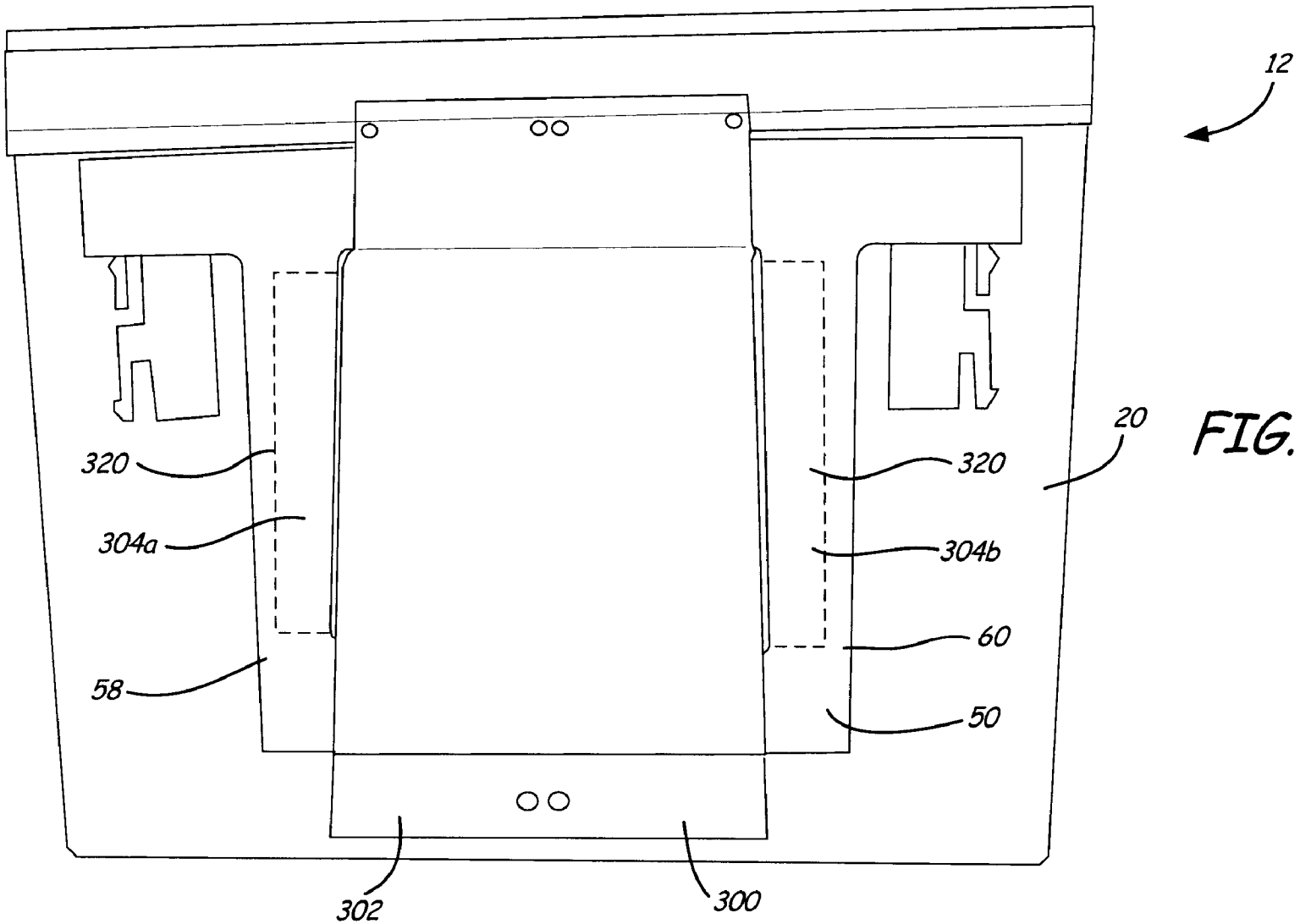
FIG. 11 is a rear view of the mount mounted to the information stand of FIG. 2, according to some embodiments.

Once in the formed state, the information stand 12 is secured to the mount 300 by positioning the end sections 320 of the mount 300 between the plate 20 and the retaining bracket 50. FIG. 11 shows a rear view of the information stand 12 with the mount 300 attached between the plate 20 and the retaining bracket 50. Referring also to FIGS. 9, 10A, 10B and 10C, to mount the wing portions 304 to the plate 20, the mount 300 is positioned at the opening 62 of the retaining bracket 50 such that the wing portions 304 are substantially aligned with the first and second side bars 58, 60 of the retaining bracket 50. The wing portions 304 are then pushed toward the body 302 such that the attachment sections 316 form an acute angle with the body 302. The intermediate sections 318 and the end sections 320 are also pushed toward each other. The end sections 320 are then slid in between the plate 20 and the retaining bracket 50 such that the end sections 320 are secured to the information stand 12 by the first and second side bars 58, 60 of the retaining bracket 50. Because the mount 300 is formed of an elastic material, when the wing portions 304 are released, the sections 316, 318, 320 of the wing portions 304 spring back to their pre-form state as shown in FIG. 9. The end sections 320 are thus angled relative to the intermediate sections 318, the intermediate sections 318 are angled relative to the attachment sections 316, and the attachment sections 316 are angled relative to the body 302. Once the mount 300 is positioned between the plate 20 and the retaining bracket 50, the information stand 12 is optionally mounted to any variety of structures.

Figure 12:
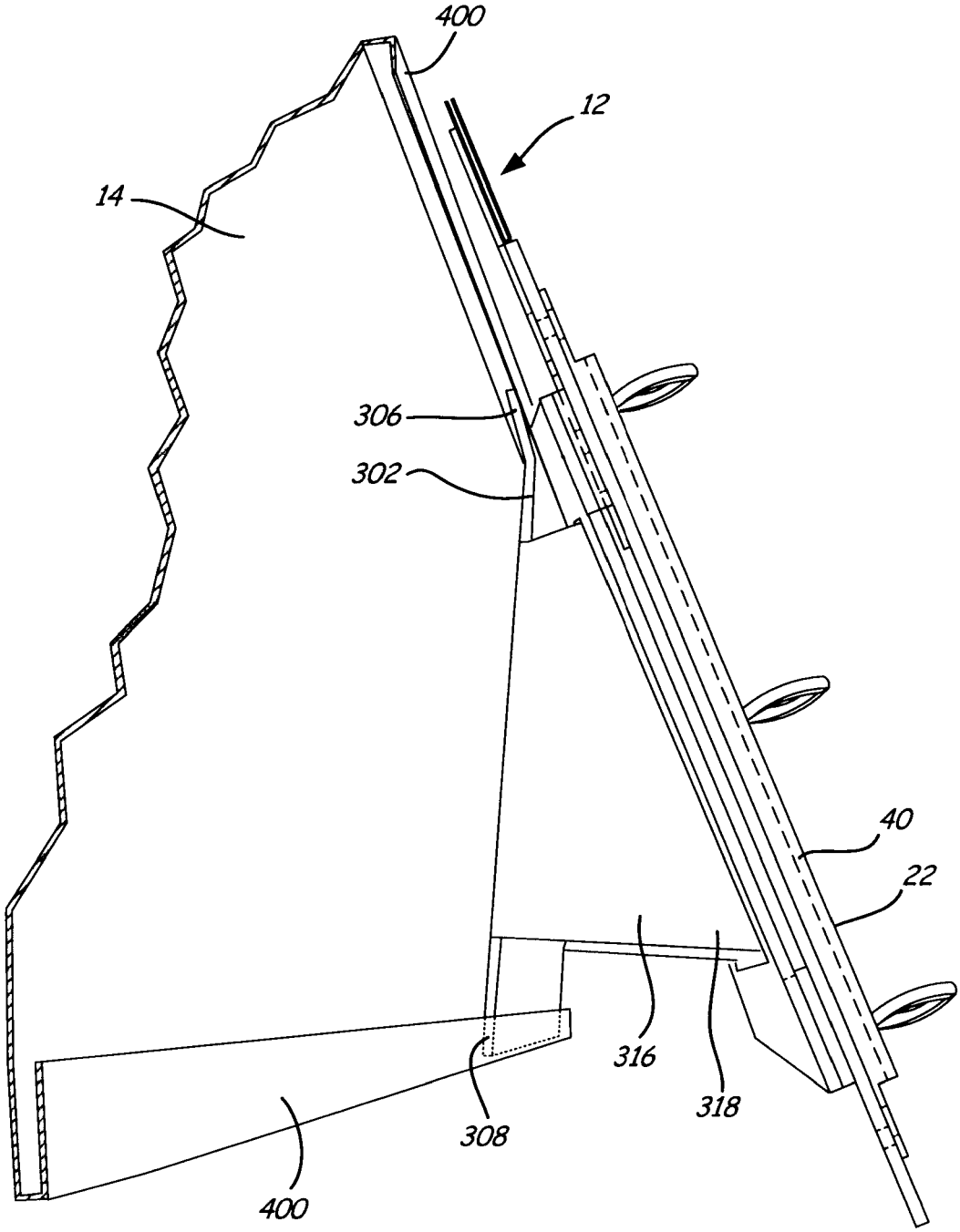
FIG. 12 is a side view of the information stand of FIG. 2 mounted to a panel of the display system of FIG. 1, according to some embodiments.

FIG. 12 shows a side view of the information stand 12 mounted to the panel 14 of the display system 10, according to some embodiments. The information stand 12 is mounted to the panel 14 by sliding the top and bottom edges 306, 308 of the body 302 into channels 400 of the panel 14. In this position, the flipbook 22 is positioned at an angle that is easy for a viewer positioned in front of the flipbook 22 to read through the contents of the sheets 40 in the flipbook 22. Although FIG. 12 depicts the panel 14 as being mounted in a substantially horizontal orientation relative to the floor, the panel 14 is optionally mounted in a substantially vertical orientation relative to the floor. In addition, the information stand 12 is optionally mounted to various other structures, such as to a pegboard by passing a nail or similar device through the apertures 314 (FIG. 9) of the body 302 and the apertures of the pegboard.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A display system comprising:

a binder including:

a plate having a front surface, a rear surface and an edge;

a plurality of sheets;

an attachment assembly to which the sheets are secured, the attachment assembly being positioned at the front surface of the plate for maintaining and displaying the sheets;

a header including indicia and being adapted to be positioned in a retracted position where the header is substantially obscured from view by the plate and an extended position where the header extends substantially from the edge of the plate;

a retaining bracket attached to the rear surface of the plate;

an extension assembly adapted to engage the retaining bracket to maintain the header in the extended position;

a mount adapted to be attached between the plate and the retaining bracket;

wherein the mount comprises a body and two wing portions, the two wing portions are spaced apart from each other and extend from the body to form a spring and are configured to be disposed between the plate and the retaining bracket;

the retaining bracket includes a top bar, a bottom bar, and two side bars, the top bar including two end portions and a middle portion, the two side bars each extending from the middle portion to the bottom bar;

the extension assembly comprises two spring clips, the two spring clips being attached to the remaining bracket through the two side bars; and the extension assembly is substantially U-shaped.

2. The display system of claim 1, further comprising:

a panel forming an upper channel and a lower channel, the upper and lower channels being adapted to support the mount edgewise such that the display system is supported from the panel.

3. The display system of claim 1, wherein the retaining bracket comprises a top bar, a bottom bar, a first side bar and a second side bar.

4. The display system of claim 1, wherein the extension assembly comprises a substantially linear portion having a first end and a second end, a first spring clip attached proximate the first end of the substantially linear portion and a second spring clip attached proximate the second end of the substantially linear portion.

5. The display system of claim 4, wherein each of the first and second spring clips includes at least one projection adapted to engage the retaining bracket when the header is in the extended position.

6. The display system of claim 4, wherein each of the first and second spring clips includes a first extension and a second extension.

7. The display system of claim 1, wherein the extension assembly is formed of a pliable material.

8. The display system of claim 5, wherein the first spring clip and the second spring clip are pliable to move from engaging the retaining bracket to disengaging the retaining bracket.

9. The display system of claim 5, wherein:

the retaining bracket comprises a top bar, a bottom bar, a first side bar and a second side bar, each of the first and second spring clips includes a first extension and a second extension, each first extension includes a protruding tooth, each second extension includes a protruding step, when the header is in the extended position, the protruding tooth of each first extension abuts an upper edge of the top bar of the retaining bracket and the protruding step of each second extension abuts a lower edge of the top bar of the retaining bracket, and the first extension and the second extension are configured to be urged inwardly to move the protruding tooth of each first extension toward the upper edge of the top bar of the retaining bracket.

10. The display system of claim 1, in combination with a retail good offered for sale, wherein the indicia of the header relates to the retail good, and the display system is positioned in close proximity to the retail good.

11. A display system comprising:

a binder including:

a plate having a front surface, a rear surface and an edge;

a plurality of sheets, an attachment assembly to which the sheets are secured, the attachment assembly being positioned at the front surface of the plate for maintaining and displaying the sheets, and a retaining bracket attached to the rear surface of the plate;

a header including indicia and an extension assembly extending therefrom adapted to engage the retaining bracket; and a mount adapted to attach between the plate and the retaining bracket, wherein when the extension assembly engages the retaining bracket:

the header is capable of moving relative to the binder and is adjustable between a retracted position where the header is substantially obscured from view by the plate and an extended position where the header extends substantially from the edge of the plate, the binder and the header form a single component and the single component is removably attached to the mount wherein the mount comprises a body and two wing portions, the two wing portions are spaced apart from each other and extend from the body to form a spring and are configured to be disposed between the plate and the retaining bracket;

the retaining bracket includes a top bar, a bottom bar, and two side bars, the top bar including two end portions and a middle portion, the two side bars each extending from the middle portion to the bottom bar;

the extension assembly comprises two spring clips, the two spring clips being attached to the retaining bracket through the two side bars; and the extension assembly is substantially U-shaped.

* * * * *